US006422272B1

(12) United States Patent
Crittenden

(10) Patent No.: US 6,422,272 B1
(45) Date of Patent: Jul. 23, 2002

(54) STRAP SEALER WITH FAST-ACTING DUAL ACTION PISTON

(75) Inventor: David E. Crittenden, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/826,342

(22) Filed: Apr. 4, 2001

(51) Int. Cl.[7] ..... B21F 15/06
(52) U.S. Cl. ..... 140/150; 92/82
(58) Field of Search ..... 140/93.2, 93.4, 140/150, 152; 100/30, 33 R; 92/82

(56) References Cited

U.S. PATENT DOCUMENTS

| | | | | | |
|---|---|---|---|---|---|
| 1,764,911 | A | * | 6/1930 | Treat | 140/150 |
| 3,089,233 | A | | 5/1963 | Meier | |
| 3,237,256 | A | | 3/1966 | Young | |
| 3,329,178 | A | * | 7/1967 | Plunkett | 140/93.4 |
| 4,289,175 | A | * | 9/1981 | Crittenden et al. | 140/93.4 |

* cited by examiner

*Primary Examiner*—Lowell A. Larson
(74) *Attorney, Agent, or Firm*—Donald J. Breh; Mark W. Croll; Lisa M. Soltis

(57) ABSTRACT

A strap sealer has a dual action piston. A seal forming assembly is operably connected to the piston. The sealer includes a housing that defines a cylinder and has a penetration therein. A piston is disposed in the cylinder for reciprocating movement. The piston defines upper and lower pressure regions of the cylinder. The sealer includes a compressed air inlet, first and second flow paths between the inlet and the upper and lower pressure regions and a valve assembly for providing flow communication between the inlet to supply air to and exhaust air from the upper and lower pressure regions. A ram is mounted to the piston for reciprocating movement therewith. The ram traverses through the housing penetration. The ram has first and second cross-sectional areas that are different from each other. As the piston reciprocates, the ram traverses through the housing penetration. When the first cross-sectional area resides at the housing penetration a seal is formed and when the second cross-sectional area passes through the housing penetration a vent path is provided from the lower pressure region outwardly to vent air from the lower pressure region.

20 Claims, 4 Drawing Sheets

STRAP SEALER WITH FAST-ACTING DUAL ACTION PISTON

BACKGROUND OF THE INVENTION

The present invention is directed to a strap sealer. More particularly, the present invention is directed to a strap sealer having a dual action piston that is vented to increase return action.

Strap material is widely used for bundling and securing loads. These strapping materials will be commonly recognized as steel or plastic strap that surrounds or encircles a load to secure the load together, e.g., bundle the load. For example, lumber is often bundled and strapped so that the individual pieces of wood are retained within the larger lumber bundle. Many types of articles are held together by strapping material, such as paper, packaging containers, bottles and the like.

The size and strength of the strap material varies depending upon the load and the tension required in the strap. For example, in the shipping industry where large containers or crates are often secured by strapping material, large width, heavy gauge strapping is used.

When secured around a load, the strapping material must be sealed or secured to itself. Various methods and devices are known for effecting these seals. One type of strapper forms seals by punching the strapping material to form interlocks between upper and lower layers of the overlapped strapping material. This is commonly referred to as a sealless strap. Another type of strap seal, typically for heavier gauge strapping material requires a separate seal that is positioned around the overlapped strapping material. This seal is then crimped at its edges and partially into the body of the seal and strap, transversely, of the seal to crimp the seal and the strapping material together. Deformation type seals such as these are disclosed in Meier, U.S. Pat. No. 3,089,233 and Young, U.S. Pat. No. 3,237,256, which patents are incorporated herein by reference.

To form the crimped or deformed seal, many types of sealers are known in the art. Such sealers can be driven electrically, pneumatically, hydraulically or the like. One known pneumatic sealer includes a housing having a piston that is positioned within a cylinder. The piston reciprocates to move a linkage to which a pair of jaw elements are connected. The jaw elements close or move together to contact the seal element to effect the crimp or seal. In such a pneumatic sealer, air pressure is used to move the piston to close the jaws. A spring is positioned at an opposing side of the piston to return the piston to its initial position (to open the jaws). While such an arrangement provides an effective drive for moving the jaws together, the spring continually acting on the piston tends to require an increased air pressure to move the jaws closed. In the event that the air pressure is constant, the spring slows down the action of the piston, thus slowing the overall sealing operation.

In addition, it has also been found that in this spring return arrangement, the jaws can get "hung-up" on the seal and the spring does not have sufficient force return the piston from the closed state to the open state.

It will be recognized that in many industries in which these sealers are used, such as manufacturing or shipping industries, the time that is afforded an operator to form these seals is minimal. As such, tools having slow response times, or tools that get "hung-up" are not acceptable in the workplace.

Accordingly, there exists a need for a sealer device that utilizes compressed air for driving a piston for moving the sealer jaws. Desirably, such a device is unbiased in that there is no constant back force on the piston as it drives the jaws closed. Most desirably, such a pneumatic sealer is fast-acting to both the sealing and opening positions, that is, to form the seal and to return to the read position.

BRIEF SUMMARY OF THE INVENTION

A strap sealer having a dual action piston and a seal forming assembly operably connected to the piston. The sealer includes a housing that defines a cylinder. The housing has a penetration therein. A piston is disposed in the cylinder for reciprocating movement therein. The piston has first and second sides and defines upper and lower pressure regions at the first and second sides of the piston.

The sealer forms a seal in a seal element and the underlying steel strapping. The seal can be of the crimped or deformed type, or may be of the notch-type, in which notches are cut into the seal element and the underlying strapping material, which notched portions may also be bent to enhance seal integrity.

The piston reciprocates to move a linkage to which a pair of jaw elements are connected. The jaw elements close or move together to contact the seal element to effect the crimp or seal. The seal can be formed by crimping or by "notching" into the seal and the straps around which the seal is positioned.

The dual action piston uses compressed gas, preferably compressed air to move the piston to close the jaw elements and to move the piston to open the jaw elements. A gas inlet is in flow communication with first and second flow paths that extend between the inlet and the upper and lower pressure regions. A valve arrangement provides flow communication between the inlet and the first and second flow paths to supply and exhaust gas to the upper and lower pressure regions.

A ram is mounted to the piston for reciprocating movement therewith. The ram traverses through the housing penetration. The ram has first and second cross-sectional areas that are different from each other.

As the piston reciprocates within the housing the ram reciprocates through the housing penetration. When the ram reciprocates through the housing penetration the and the first cross-sectional area resides at the housing penetration, it forms a seal therebetween. When the second cross-sectional area passes through the housing penetration a vent path is provided from the lower pressure region outwardly to vent gas from the lower pressure region.

Advantageously, the present sealer uses a compressed gas, preferably compressed air for driving the piston for moving the sealer jaws. The present sealer uses compressed air, without a spring assist to move the piston. Thus, there is no constant back force on the piston as it drives the jaws closed. The present dual action piston is fast-acting to both the sealing and opening positions, that is, to form the seal and to return to the ready or at-rest position.

In a current embodiment, the first and second cross-sectional areas of the ram are defined by an undercut region in the ram. Preferably, the undercut region is defined by at least first and second different diameters. Most preferably, the undercut includes flats extending along a portion of the ram.

In the current embodiment, the seal forming assembly includes jaw elements that are moveable toward and away from one another between the open condition and the closed position for forming the strap seal. The vent path from the lower pressure region exhausts air from the lower pressure region when the jaw elements are moved from the open condition to the closed position. The vent path can vent to the seal forming assembly.

In a preferred embodiment, the sealer includes a sealing element at the housing penetration. The sealing element can be an O-ring or like flexible element.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
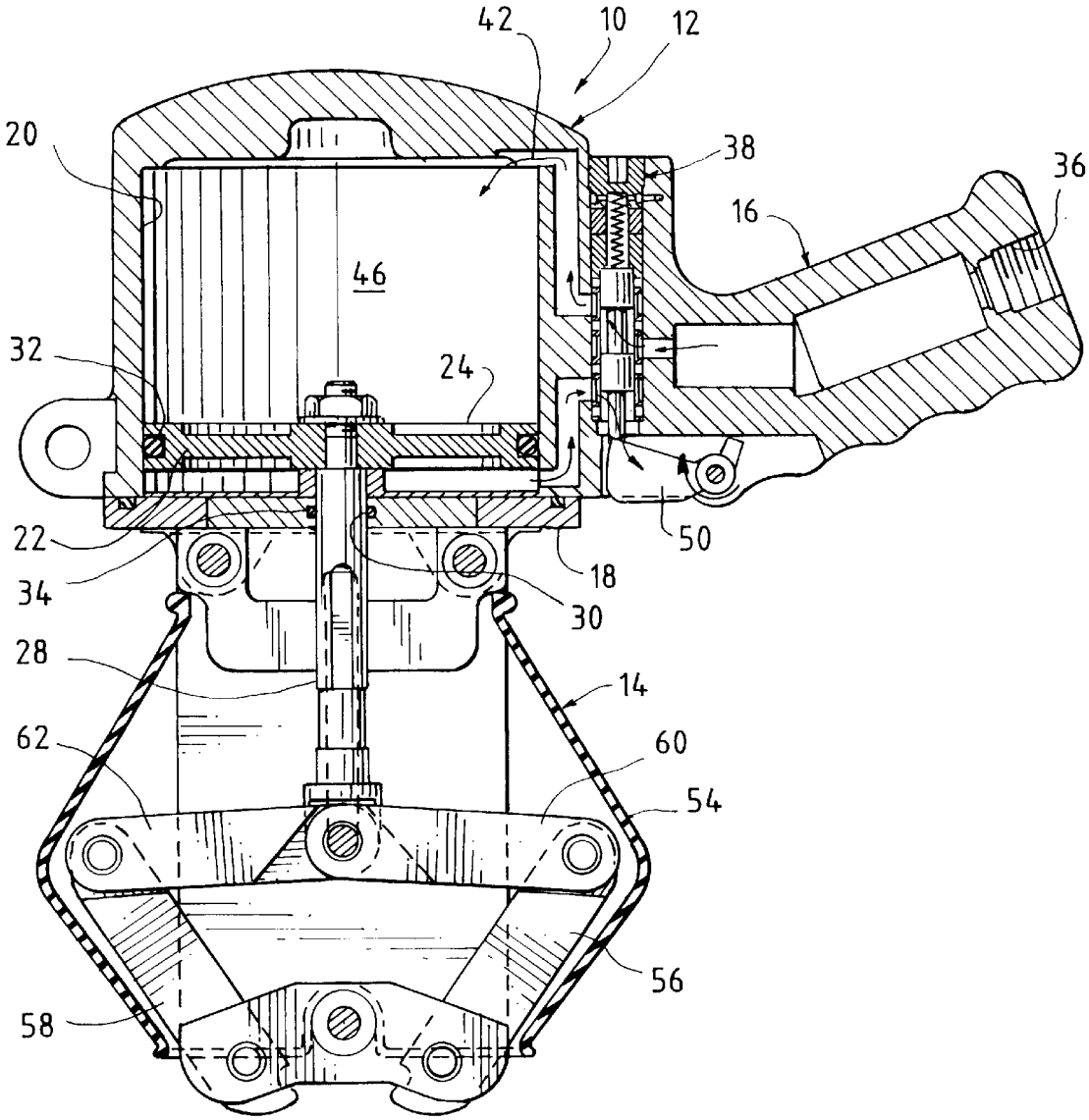
FIG. 1 is a partial cross-sectional illustration of an exemplary sealer having a fast-acting dual action piston in accordance with the present invention, the sealer being illustrated in the sealing state.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown an exemplary sealer 10 having a fast-acting dual action piston embodying the principles of the present invention. The sealer 10 includes generally a housing 12, a seal forming assembly 14 and a handle 16. The seal forming assembly 14 is mounted to a base 18 of the housing 12. The base 18 is preferably mounted to the housing 12 by fasteners (not shown), such as screws, bolts or the like. The handle 16 extends from the housing 12 and can be formed as part of the housing 12. Alternately, the handle 16 can be mounted to the housing 12 in a sealed arrangement.

Figure 2:
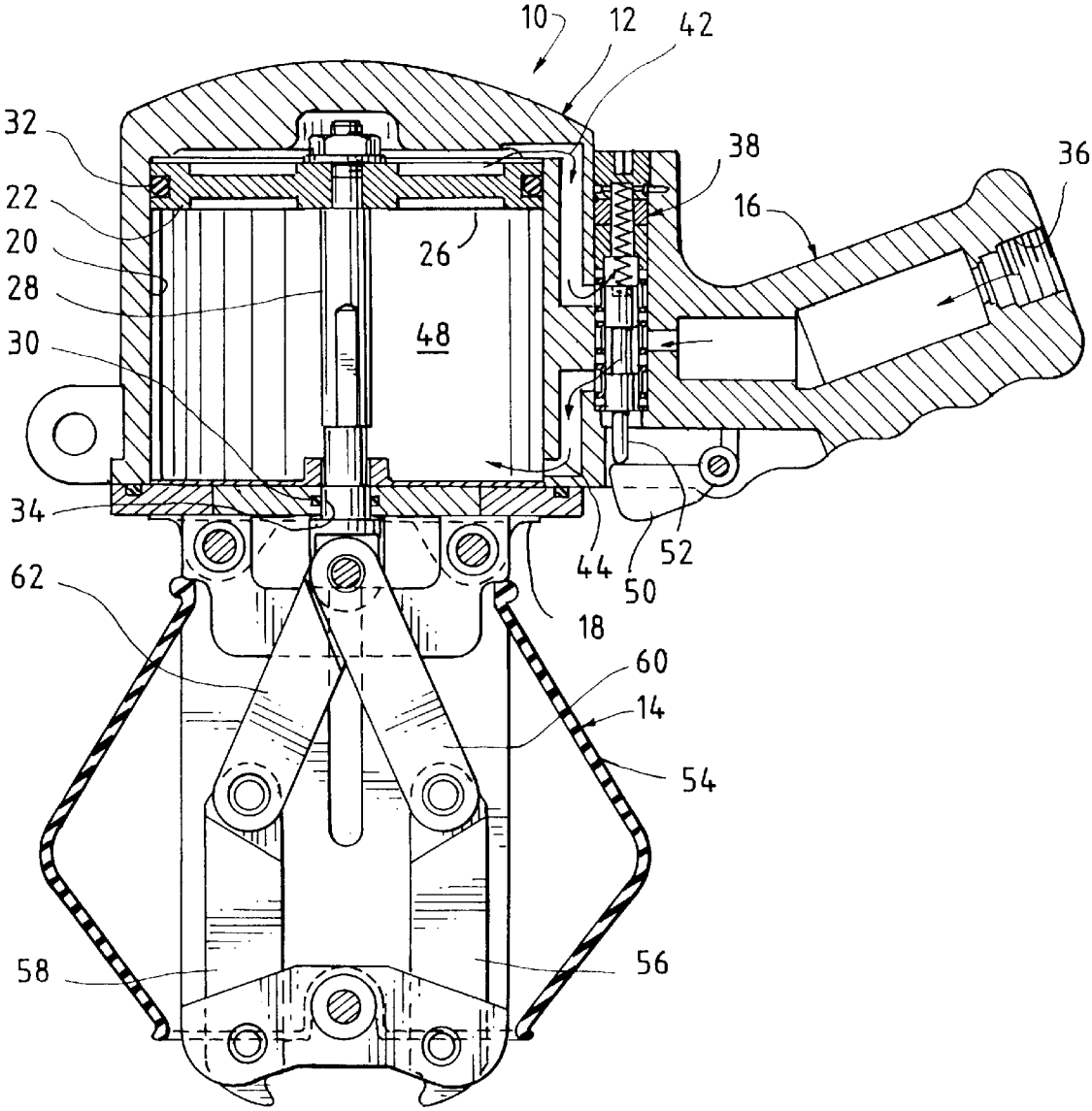
FIG. 2 is a partial cross-sectional view of the sealer of FIG. 1 with the piston in the at-rest state.
Figure 3:
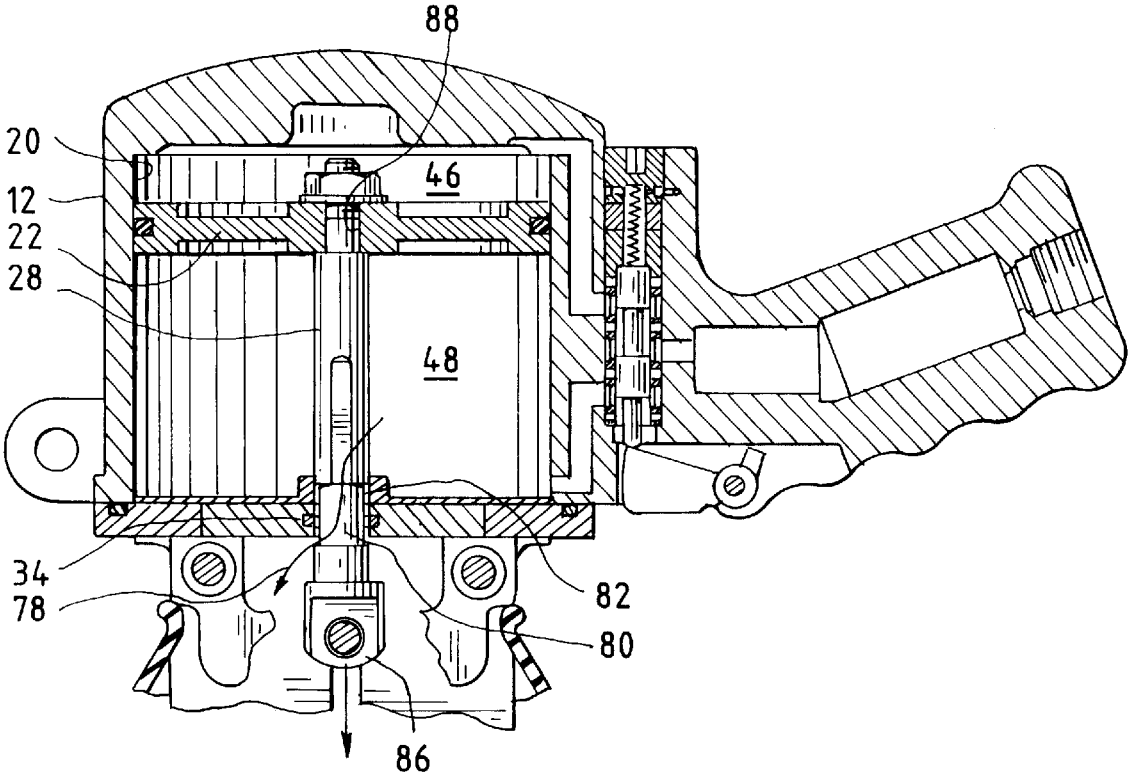
FIG. 3 is a partial cross-sectional view of a portion of the piston illustrating the ram traversing through the housing penetration, as the piston moves from the at-rest state to the sealing state.

The housing 12 defines a cylinder 20 in which a piston 22 is mounted for reciprocating movement between a sealing or closed position as shown in FIG. 1, and an at-rest or open position as shown in FIG. 2. FIG. 3 is a transitional view of the piston 22 as is moves from the open position to the closed position.

The piston 22 is a dual-action piston. That is, pressurized fluid is applied to move the piston 22 in both directions. To this end, the piston 22 has upper and lower surfaces 24, 26, both of which are configured for having pressurized fluid applied to them.

A ram 28 is sealingly mounted to the piston 22 for reciprocating movement therewith. Essentially, the ram 28 defines a stem mounted to the piston 22, that traverse through a penetration 30 in the housing 12 at the base 18 thereof. The piston 22 is sealed at its periphery, against the cylinder 20 wall, by sealing element 32 such as the exemplary O-ring. A sealing element 34, such as the exemplary O-ring is positioned at the penetration 30 and forms a seal at the housing penetration 30 for the ram 28.

The handle 16 is configured to provide a grip for the sealer 10. In addition, as illustrated in the exemplary sealer 10, the handle 16 can be configured having an fluid (such as air or pneumatic supply) inlet 36 for the sealer tool 10. A valve assembly 38 resides in a valve sleeve 40 that is positioned between the supply inlet 36 and first and second flow paths (as indicated at 42 and 44, respectively) between the supply 36 and the cylinder 20.

In a present embodiment, the valve assembly 38 is positioned in the sleeve 40 in the handle 16 (or at about a transition of the handle 16 and the housing 12). The first and second flow paths 42, 44 are formed in the housing 12 extending from the valve assembly 38 through the housing 12 into upper and lower pressure regions (as indicated at 46 and 48, respectively) of the cylinder 20.

A trigger 50 is mounted to the housing 12 at about the handle 16. The trigger 50 engages a valve stem 52 that actuates the valve assembly 38. The valve assembly 38 is configured to direct fluid, presently contemplated to be compressed air, into and to vent air from, both the upper and lower pressure regions 46, 48 of the cylinder 20, as described below.

The seal forming assembly 14 includes an outer boot 54, first and second, opposing jaw elements 56, 58 and a linkage, having first and second linkage arms 60, 62 that extend between and operably connect the jaw elements 56, 58 and the ram 28. To this end, the ram 28 extends through the housing 12, at the penetration 30, into the seal forming assembly 14.

As will be recognized by those skilled in the art, the jaws 56, 58 close (as seen in FIG. 1) onto a seal that is positioned around the overlapping strapping material. The jaws 56, 58 can be configured to crimp the seal, as by deformation, or can be configured to "cut" notches into the seal and the underlying strapping. The notches may be further bent to enhance seal integrity. All such sealing methods are encompassed by the term crimping as used herein, will be appreciated by those skilled in the art, and are within the scope and spirit of the present invention.

As the piston 22 moves from the sealing position (FIG. 1) to the at-rest position (FIG. 2), the ram 28 moves along with the piston 22 to urge the sealer links 60, 62 upwardly to open the jaw elements 56, 58. Conversely, as the piston 22 moves from the at-rest position to the sealing position, the ram 28 is urged downwardly urging the sealer links 60, 62 away from one another to close the jaw elements 56, 58.

Referring now to FIG. 1, when in the sealing position, compressed air is supplied to the upper pressure region 46 through the flow path indicted at 42, and air is vented from the lower pressure region 48 through the flow path indicated at 44. Conversely, as seen in FIG. 2, when in the at-rest position, compressed air is supplied to the lower pressure region 48 through flow path 44 and air is vented from the upper pressure region 46 through flow path 42.

Figure 7:
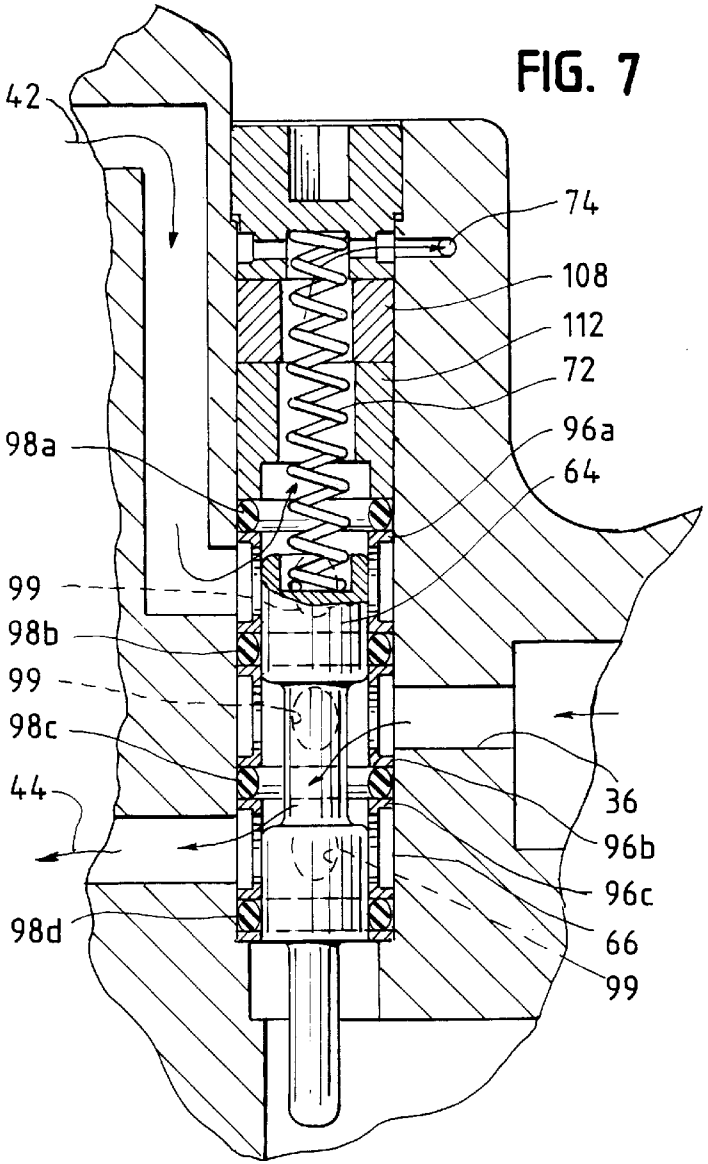
FIG. 7 is a an enlarged, partial cross-sectional view of the valve assembly illustrated in a position corresponding to that of the piston being in the at-rest state of FIG. 2.
Figure 6:
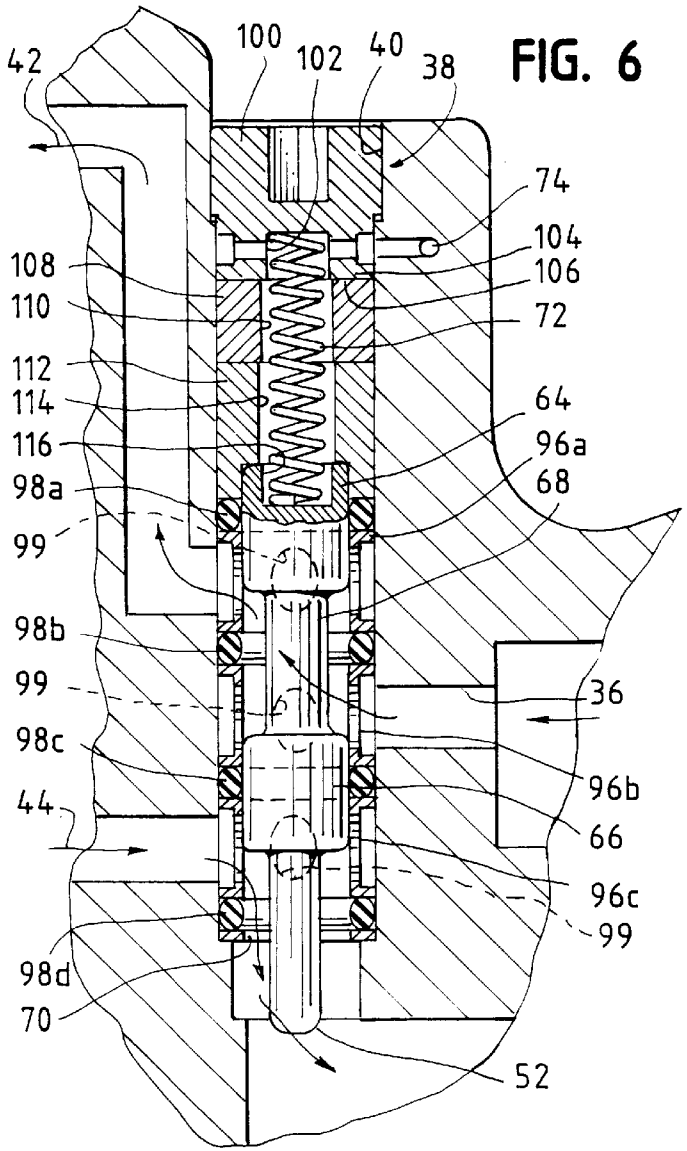
FIG. 6 is an enlarged, partial cross-sectional view of the valve assembly illustrated in a position corresponding to that of the piston being in the sealing state of FIG. 1.

Referring now to FIGS. 6 and 7, to effect this redirection of compressed air supply and exhaust, the valve stem 52 reciprocates within the bore 40, opening the flow paths 42, 44 to the upper and lower pressure regions 46, 48. The valve stem 52 is formed having upper and lower sealing lobes 64, 66 and a central flow passage 68 between the lobes 64, 66. The valve assembly 38 includes a plurality of valve sleeves 96*a–c* positioned within the bore 40 and separated from one another by seals 98*a–b,* such as the exemplary O-rings. The sleeves 96*a–c* are formed having openings 99 therein to provide flow communication between the inlet 36 and the flow paths 42, 44 and the exhaust ports 70, 74 and the flow paths 42, 44. A present assembly 38 includes three valve sleeves, one each associated with the inlet 36, the upper pressure region flow path 42 and the lower pressure region flow path 44.

As best seen in FIG. 6, the stem 52 reciprocates upward by actuation of or engagement by the trigger 50 (to route air to the upper pressure region 46) to position the central flow passage 68 between the upper region sleeve 96*a* and the inlet sleeve 96*b*. In this position, compressed air flows from the inlet 36 through the openings in sleeve 96*b,* around flow passage 68, through upper region sleeve 96*a* openings, and into flow path 42. At this position, the upper lobe 64 isolates the upper exhaust port 74, by forming a seal at the lobe 64/O-ring 98*a* juncture to prevent venting the upper pressure region 46.

In this stem 52 position, the lower lobe 66 is positioned (and forms a seal) between the inlet sleeve 96*b* and the lower pressure region sleeve 96*c*. This isolates the flow of compressed air to the lower pressure region flow path 44. At this position, the lower pressure region flow path 44 is open to the stem exhaust port 70 through the openings in sleeve 96*c*.

Referring now to FIG. 7, the stem 52 reciprocates downward (to route air to the lower pressure region 48) by the return action of the spring 72. This locates the central flow passage 68 between the lower region sleeve 96*c* and the inlet sleeve 96*b*. In this position, compressed air flows from the inlet 36 through the openings in sleeve 96*b,* around the central passage 68, through sleeve 96*c* openings, and into flow path 44. At the same time, the lower lobe 66 is positioned to isolate the stem exhaust port 70, by forming a seal at the lobe 66/O-ring 98*d* juncture to prevent venting the lower pressure region 48.

When in this stem 52 position, the upper lobe 64 is positioned (and forms a seal) between the inlet sleeve 96*b* and the upper pressure region sleeve 96*a*. This isolates the flow of compressed air to the upper pressure region flow path 42. At the same time, the upper pressure region flow path 42 is open to the exhaust port 74 through the openings in sleeve 96*a,* up through the spring 72, and out through the port 74. The exhaust port 74 thus provides an opening to the environment to exhaust or vent air from the upper pressure region 46. Those skilled in the art will, from a study of the drawings, recognize and appreciate the valve assembly 38 arrangement and operation.

The valve 38 has a novel arrangement to provide for adjustment to assure that air is directed from and to the proper paths. A threaded cap 100 (threads not shown) maintains the valve assembly 38 intact within the bore 40. The cap 100 includes a central well 102 that defines a plug 104. A bearing surface 106 at an end of the plug 104 bears against a resilient element 108 having a bore 110 through the center thereof. A rigid element 112 is aligned with the resilient element 108, which rigid element 112 also has a bore 114 through the center thereof. The resilient element 108 can be formed of rubber, various appropriate polymeric materials and the like, and rigid element 112 can be formed of, for example, steel.

The rigid element 112 is positioned on the uppermost O-ring 98*a*. The spring 72 is positioned in the cap well 102 and extends through the resilient and rigid element center bores 110, 114, respectively. The spring 72 resides within a well 116 in a top of the stem 52 and applies the force to return the stem 52 to the downward position (as illustrated in FIG. 7) to pressurize the lower pressure region 48 and vent the upper pressure region 46.

By threading the cap 110 inward of the housing 12 (i.e., tightening down the cap 100), an increased force is exerted onto the resilient and rigid elements 108, 112. This force compresses the O-rings 98*a–d,* which results in the O-rings 98*a–d* flattening longitudinally and expanding radially inwardly and outwardly. This reduces the inside diameter across each of the O-rings 98*a–d,* which in turn "tighten" around the lobes 64, 66. This effectively reduces leakage across the valve assembly 38. The cap 100 can be "tightened" or "loosened" to reduce leakage or to facilitate movement of the stem 52 within the sleeves 96*a–c* and O-rings 98*a–d.*

As set forth above, the ram 28 interconnects the piston 22 and the seal forming assembly 14. To this end, the ram 28 traverses through the housing penetration 30 and extends between the piston 22 and the linkage arms 60, 62.

The present sealer 10 provides an additional flow or vent path, as best seen in FIG. 3, as indicated at 78, for venting the lower pressure region 48 during the closing stroke (that is moving from the at-rest position to the closed position). It has been found that this venting capability provided by this additional vent path 78 reduces the stroke time in moving the piston 22 through this closing stroke.

Figure 4:
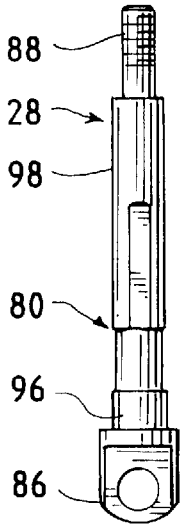
FIG. 4 is a front view (as seen from FIGS. 1–3) of the undercut ram used in the present sealer.
Figure 5:
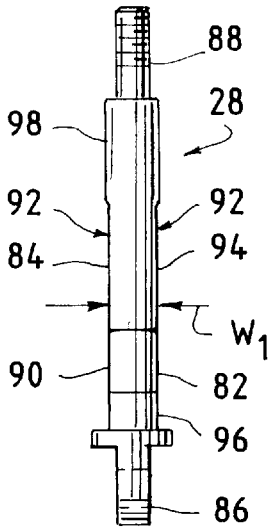
FIG. 5 is a side-view of the ram of FIG. 4.

The present 10 sealer includes an undercut portion (as indicated generally at 80 in FIGS. 4–5) in the ram 28, which undercut portion 80 traverses through the housing penetration 30 during piston 22 stroke. The undercut portion 80 includes a narrowed diameter 82 along an intermediate portion 84 of the ram 28 between the linkage connection 86 and the piston connection 88. As best seen in FIGS. 4 and 5, at about the piston connection 88 and the linkage connection 86, the ram 28 has a circular cross-section or cylindrical shape that conforms to the penetration 30 with the seal 34 in place. Thus, a complete seal is formed between the ram 28 and the penetration 30 (by the seal 34), when the piston 22 is at the fully open or fully closed position. However, as the piston 22 moves from the at-rest position to the closed position (FIG. 3 indicating an intermediate position), the reduced ram shaft diameter at the undercut portion 80, establishes a flow path 78 between the lower pressure region 48 and the seal forming assembly 14, through the penetration 30, past seal 34. In that the seal forming assembly 14 is open to the environs, the flow path 78 is essentially established from the lower pressure region 48 to the environs, thus assisting the venting of the lower pressure region 48.

Referring again to FIGS. 4 and 5, the undercut 80 is formed in the ram 28 to reduce the overall cross-sectional area of the ram 28. A width $w_1$ dimension of the ram 28 is reduced at a first reduced section 90. As seen in FIG. 5, the reduced width section 90 results in "flats", as indicated at 92, that extend along a second reduced portion 94 of the ram 28. The flats 92 transition into the first reduced diameter portion 90 which, further along transitions to the linkage connection 86. To this end, the portion of the ram indicated generally at 80, which portion traverses through the housing penetration 30, has two reduced cross-sectional areas (the first and second reduced diameter portions 90, 94), as compared to the full cross-sectional areas (as indicated at 96, 98) adjacent the linkage and piston connections that provide this additional vent path 78.

As will be appreciated by those skilled in the art, the reduced cross-sectional area of the undercut portion 80 provides the additional vent path 78 from the lower pressure region 48, which increases the overall flow area for exhausting air from the lower pressure region 48 when the sealer 10 is actuated and the piston 22 moves from the at-rest position to the sealing position. Those skilled in the art will appreciate that this increased flow area thus reduces the resistance to movement of the piston 22 from the at-rest position to the sealing position without additional mechanical assistance, such as springs and the like.

It has also been found that the undercut ram 28 does not adversely effect the return of the piston 22 from the sealing position to the at-rest position. That is, although there will inherently be a slight increase in the time required to pressurize the lower pressure region 48, this increase in time is not sufficiently great to adversely effect the overall operation of the sealer tool 10.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A strap sealer having a dual action piston comprising:

a housing defining a cylinder, the housing defining a penetration therein;

a piston disposed in the cylinder for reciprocating movement therein, the piston having first and second sides, the piston defining upper and lower pressure regions at the first and second sides of the piston;

a gas inlet;

first and second flow paths extending between the gas inlet and the upper and lower pressure regions, respectively;

a valve arrangement for providing flow communication between the gas inlet and the first and second flow paths for supply and exhausting gas to the upper and lower pressure regions;

a ram mounted to the piston for reciprocating movement therewith, the ram traversing through the housing penetration, the ram having first and second cross-sectional areas different from each other; and a seal forming assembly operably connected to the ram, wherein as the piston reciprocates within the housing the ram reciprocates through the housing penetration, and wherein when the ram reciprocates through the housing penetration the first cross-sectional area resides at the housing penetration forming a seal therebetween, and wherein when the ram reciprocates through the housing penetration and the second cross-sectional area passes through the housing penetration a vent path is provided from the lower pressure region outwardly to vent gas from the lower pressure region.

2. The strap sealer in accordance with claim 1 wherein the second cross-sectional area of the ram is defined by an undercut region in the ram.

3. The strap sealer in accordance with claim 2 wherein the undercut region is defined by at least first and second different diameters.

4. The strap sealer in accordance with claim 2 wherein the undercut includes flats extending along a portion of the ram.

5. The strap sealer in accordance with claim 1 wherein the seal forming assembly includes jaw elements moveable toward and away from one another between an open position and a closed position for forming a seal in a strap.

6. The strap sealer in accordance with claim 5 wherein the vent path from the lower pressure region exhausts gas from the lower pressure region when the jaw elements are moved from the open condition to the closed position.

7. The strap sealer in accordance with claim 1 wherein the vent path vents to the seal forming assembly.

8. The strap sealer in accordance with claim 1 including a sealing element at the housing penetration.

9. The strap sealer in accordance with claim 1 wherein the ram includes a third cross-sectional area different from the first and second cross-sectional areas.

10. The strap sealer in accordance with claim 9 wherein the third cross-sectional area is less than the first cross-sectional area and is greater than the second cross-sectional area.

11. A strap sealer having a dual action piston comprising:

a housing defining a cylinder, the housing defining a penetration therein;

a piston disposed in the cylinder for reciprocating movement therein;

upper and lower pressure regions defined by the piston in the cylinder;

a compressed fluid inlet;

first and second flow paths extending between the compressed fluid inlet and the upper and lower pressure regions, respectively, the first and second flow paths providing flow communication between the compressed fluid inlet and the upper and lower pressure regions;

a stem mounted to the piston for reciprocating movement therewith, the stem traversing through the housing penetration, the stem having first and second cross-sectional areas, the first cross-sectional area being greater than the second cross-sectional area, wherein when the second cross-sectional area resides at the penetration a third flow path is provided from the lower pressure region outwardly to vent the lower pressure region; and a seal forming assembly operably connected to the stem.

12. The strap sealer in accordance with claim 11 wherein the second cross-sectional area of the stem is defined by an undercut region therein.

13. The strap sealer in accordance with claim 12 wherein the undercut region is defined by at least first and second different diameters.

14. The strap sealer in accordance with claim 12 wherein the undercut region includes flats extending along a portion of the stem.

15. The strap sealer in accordance with claim 11 wherein the seal forming assembly includes jaw elements operably connected to the stem, the jaw elements being moveable toward and away from one another between an open condition and a closed position for forming a seal in a strap.

16. The strap sealer in accordance with claim 15 wherein the vent path from the lower pressure region exhausts fluid from the lower pressure region when the jaw elements are moved from the open position to the closed position.

17. The strap sealer in accordance with claim 11 wherein the vent path vents to the seal forming assembly.

18. The strap sealer in accordance with claim 11 including a sealing element positioned at the housing penetration.

19. The strap sealer in accordance with claim 11 wherein the stem includes a third cross-sectional area different from the first and second cross-sectional areas.

20. The strap sealer in accordance with claim 19 wherein the third cross-sectional area is less than the first cross-sectional area and is greater than the third cross-sectional area.

* * * * *